US006333476B1

(12) United States Patent
Umemura

(10) Patent No.: US 6,333,476 B1
(45) Date of Patent: Dec. 25, 2001

(54) PUSH-BUTTON SWITCH

(75) Inventor: Heihachiro Umemura, Sakai (JP)

(73) Assignee: Shinkoh Electric Co., Ltd., Osaka (JP)

( * ) Notice: Subject to any disclaimer, the term of this patent is extended or adjusted under 35 U.S.C. 154(b) by 0 days.

(21) Appl. No.: 09/676,530

(22) Filed: Oct. 2, 2000

(30) Foreign Application Priority Data

Oct. 12, 1999 (JP) ..... 11-289130

(51) Int. Cl.[7] ..... H01H 3/12
(52) U.S. Cl. ..... 200/318.1; 200/523
(58) Field of Search ..... 200/5 E, 5 EA, 200/5 EB, 50.32–50.37, 520–553, 329–330, 523, 318.1

(56) References Cited

U.S. PATENT DOCUMENTS 5,272,383 * 12/1993 Umemura ..... 307/112
5,576,525 * 11/1996 Umemura ..... 200/539
5,932,854 * 8/1999 Umemura ..... 200/5 B
5,965,854 * 10/1999 Umemera ..... 200/5 E
5,994,652 * 11/1999 Umemera ..... 200/5 B

FOREIGN PATENT DOCUMENTS

64615 * 4/1982 (EP) .

* cited by examiner

*Primary Examiner*—Renee Luebke
*Assistant Examiner*—Nhung Nguyen
(74) *Attorney, Agent, or Firm*—Wenderoth, Lind & Ponack, L.L.P.

(57) ABSTRACT

The present invention, the objective of which is to provide a push-button switch realized in a way to be held lightly with a small force at the position where the push button is pressed, and obtain a large returning force when the pressing force of the push button is released, is a push-button switch realized by slidably disposing the push button on the switch body and urging it with a return spring, comprising a hole formed in the push button in its pressing direction, a spring for balls inserted in said hole, a window opening on the side face of the push button in communication with the bottom of the hole, a ball for temporary fastening disposed at said window, a concavity, formed along the wall face on the switch body side on which the push button slides, in which to fit part of the ball for temporary fastening at the position where the push button is pressed, and an auxiliary push button, disposed at the top of the push button in a way to be pressed, by being urged by said spring for ball, for pressing the ball for temporary fastening to outside through the spring for ball with pressing, to fit part of the pushed out ball for temporary fastening in the concavity formed along the wall face on the switch body side.

2 Claims, 10 Drawing Sheets

PUSH-BUTTON SWITCH

BACKGROUND OF THE INVENTION

The present invention relates to a push-button switch used for operating a crane or a hoist, more specifically a push-button switch realized in such a way that the push button can be held lightly at the current position when the push button of the push-button switch is pressed down.

PRIOR ART

As push-button switch provided with a clip mechanism for temporarily fastening the push button at the current position when the switch is pressed down, a type as shown in FIG. 10, has so far been widely used, for example.

This push-button switch is realized by disposing steel balls 29 urged by a spring for steel ball 28 on a push button 27, and forming a stepped part for clip 31 in a way to face the steel balls 29 along the wall face of the switch body 30 on which the push button 27 slides, so as to clip the push button 27 at prescribed pressed down position by fastening the steel balls 29 to this stepped part for clip 31 when the push button 27 is pressed down.

By the way, a push-button switch used for operating a crane or a hoist allows the crane, etc. to work while the switch operation is made for a fairly long time when making a travelling motion. On this type of push-button switch is disposed a return spring for urging the push button in the direction opposite to the direction of the pressing down operation, to make the push button return to its initial position when the pressing down operation is released and, usually, a spring having a comparatively large spring constant is used as return spring, so that the push button may return accurately even when dust, etc. is bitten there.

For that reason, the holding pressure of the push button inevitably increases, and said conventional type of push button had a problem of poor operability such as fatigue of the finger pressing the push button in the case of a long operating time.

SUMMARY OF THE INVENTION

The objective of the present invention is to provide, in view of the problem of said conventional type of push buttons, a push-button switch realized in a way to be held lightly with small force at the position where the push button is pressed, and obtain a large returning force when the pressing force of the push button is released.

To achieve said object, the push-button switch according to the present invention is realized as a push-button switch slidably disposing the push button on the switch body and urging it along with a return spring, characterized in that it comprises a hole formed in the push button in its pressing direction, a spring for balls inserted in said hole, a window opening on the side face of the push button in communication with the bottom of the hole, a ball for temporarily fastening disposed at said window, a concavity, formed along the wall face on the switch body side on which the push button slides, in which to fit part of the ball for temporary fastening at the position where the push button is pressed, and an auxiliary push button, disposed at the top of the push button in a way to be pressed, by being urged by said spring for ball, for pressing the ball for temporary fastening to the outside through the spring for ball while pressing, to fit part of the pushed out ball for temporary fastening in the concavity formed along the wall face on the switch body side.

This push-button switch presses the ball for temporary fastening to the outside through the spring for ball with the pressing made simultaneously with the pressing of the auxiliary push button.

With this operation, part of the pushed out ball for temporary fastening is made to fit in the concavity formed along the wall face of the switch body side, and the push button is temporarily fixed at the current position by the resisting force produced by the fitting of this ball for temporary fastening in the concavity, making it possible to lightly hold the push button pressed against the return spring with a small force.

Moreover, when releasing the pressing force on the push button, the pressing force pushing the ball for temporary fastening to the outside diminishes.

As a result, the fitting of the ball for temporary fastening in the concavity formed along the wall face on the switch body side is disengaged, and the urging force of the return spring acts directly on the push button, thus obtaining a large return force.

This makes it possible to provide a highly safe push-button switch with excellent operability, reducing the burden on the operating worker.

In this case, it is possible to form a concavity in which to fit part of the ball for temporary fastening at the position where the push button is returned, along the wall face on the switch body side on which the push button slides.

With this arrangement, part of the ball for temporary fastening is subject to a resisting force by being fit in the concavity formed at the position where the push button returns to at the start of the pressing of the auxiliary push button, and the push button is pressed at a stroke after accumulating a force until this ball for temporary fastening retreats and gets away from the concavity against the spring for ball. As a result, the contact of the switch body can be instantly connected.

This helps improve the durability of the equipment by reducing electric exhaustion of the contact, and by preventing occurrence of troubles such as burning of motors, etc., especially with the improvement of operability of push-button switches with 2*a* contacts requiring opening and closing of 2 contacts without any time lag.

DETAILED DESCRIPTION OF THE INVENTION

Figure 1:
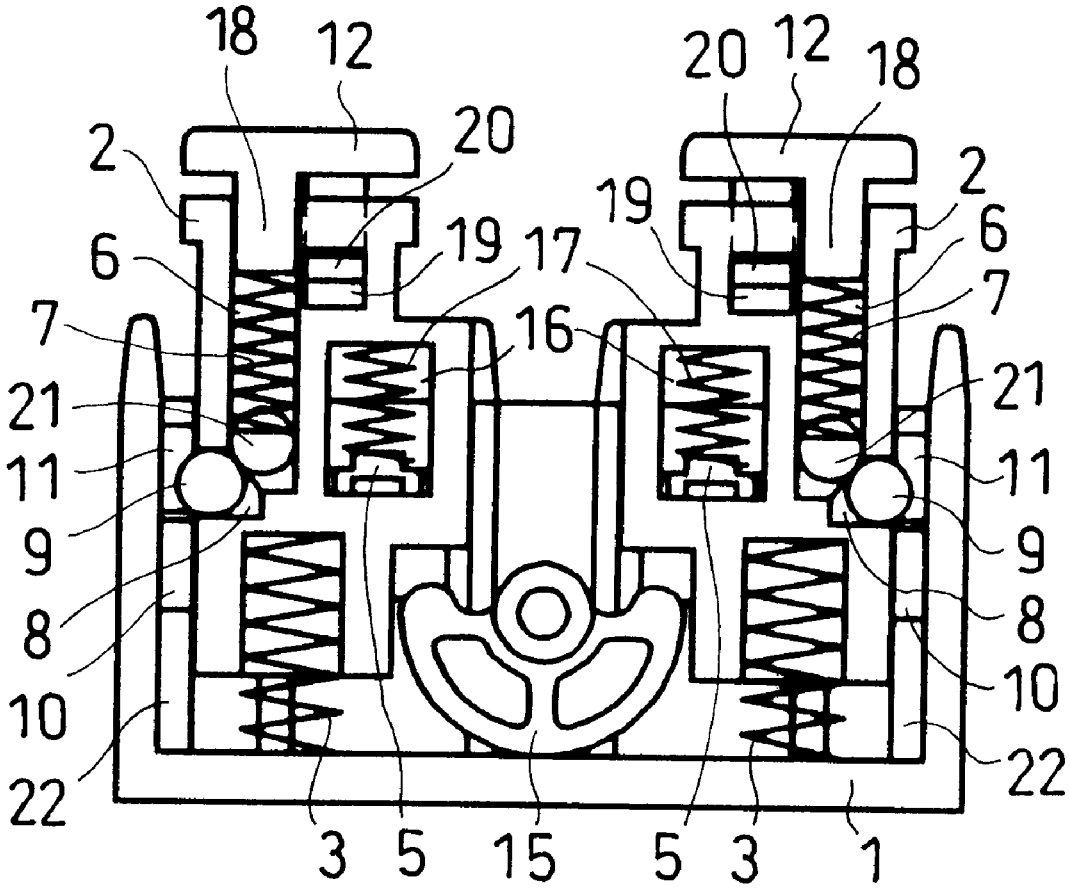
FIG. 1, indicating the first embodiment of the push-button switch according to the present invention, is a sectional view showing a state in which no pressing operation of the push button is made.

Embodiments of the push-button switch according to the present invention will be explained hereafter based on drawings.

FIG. 1 to FIG. 7 indicate the first embodiment of the push-button switch according to the present invention.

This push-button switch is realized by slidably disposing left and right push buttons 2 on the switch body 1 by urging them with a return spring 3 respectively, so that a fixed contact 4 of the switch body 1 may be connected with a mobile contact 5 with pressing down of the push button 2.

And, this push-button switch is constructed by comprising a hole 6 formed in the push button 2 in its pressing direction, a spring for balls 7 inserted in the hole 6, a window 8 opening on the side face of the push button 2 in communication with the bottom of the hole 6, a ball for temporary fastening 9 disposed at the window 8, a concavity 10, formed along the wall face on the switch body 1 side on which the push button 2 slides, in which to fit part of the ball for temporary fastening 9 at the position where the push button 2 is pressed, a return side concavity 11, formed above this concavity 10, to fit part of the ball for temporary fastening 9 at the position where the push button 2 returned, and an auxiliary push button 12, disposed on the push button 2 in a way to be pressed, by being urged by the spring for ball 7, for pressing the ball for temporary fastening 9 to outside through the spring for ball 7 with pressing of the auxiliary push button 12.

On the switch body 1 are formed longitudinal holes 13 in which the left and right push buttons 2 are slidably inserted respectively and transversal holes 14 through the longitudinal holes 13, and the fixed contact 4 is fixed to this transversal hole 14.

Moreover, between the left and right longitudinal holes 13 is disposed an interlock 15, preventing the left and right push buttons 2 from being pressed simultaneously.

The push button 2 is inserted in the longitudinal hole 13 of the switch body 1 through the return spring 3, and in a space 16 formed in the shaft are disposed a mobile contact 5 and a spring for mobile contact 17 which elastically fixes this mobile contact 5.

The returning position of this push button 2, urged upward by the return spring 3, is determined as the mobile contact 5 gets in contact with the top of the transversal hole 14 in the switch body 1.

On the other hand, the auxiliary push button 12, having a sliding shaft 18 to be inserted in the hole 6 of the push button 2 and 2 hook-shaped claw members 20 to be engaged with U-shaped holes 19 at the top of the push button 2, is urged upward by the spring for ball 7 through the sliding shaft 18 and protected against falling by the claw member 20.

Namely, as this auxiliary push button 12 is pushed down against the spring for ball 7, it is urged by the compressed spring for ball 7, to push the ball for temporary fastening 9 to outside.

At the bottom of the spring for ball 7 is provided a pressing ball 21, so that the spring for ball 7 may rub the surface of the ball for temporary fastening 9 in the window 8 through the pressing ball 21, to smoothly press and push the ball for temporary fastening 9 to outside.

The spring force of this spring for ball 7 is set fairly smaller compared with that of the return spring 3 of the push button 2.

The window 8, formed adjacent to and obliquely below the hole 6 in a way to communicate with the bottom of the hole 6, is formed with a rather narrow space against the hole 6, to prevent the ball for temporary fastening 9 in the window 8 from moving into the hole 6.

The window 8 is formed in a size sufficient for allowing free fitting of the ball for temporary fastening 9 to it.

Furthermore, on the side face of the push button 2, a metallic or rigid resin plate 22 is fixed as wall face to the switch body 1, and in this plate 22 are formed a concavity 10 and a return side concavity 11 in which to selectively fit the ball for temporary fastening 9.

The concavity 10 has a stepped part 10*a* in which to fasten the ball for temporary fastening 9 in the returning direction on the push-in side, while the return side concavity 11 has a stepped part Ha in which to fasten the ball for temporary fastening 9 on the return side.

The ball for temporary fastening 9 and said pressing ball 21 to be engaged in those concavity 10 and return side concavity 11 are formed with either a metallic or a rigid resin material.

Next, explanation will be made of the actions of the push-button switch having said construction.

Figure 2:
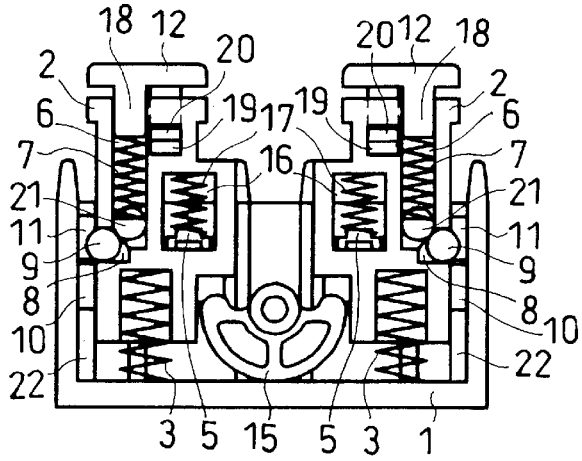
FIG. 2 is an explanatory chart showing the motion of said push-button switch.
Figure 2:
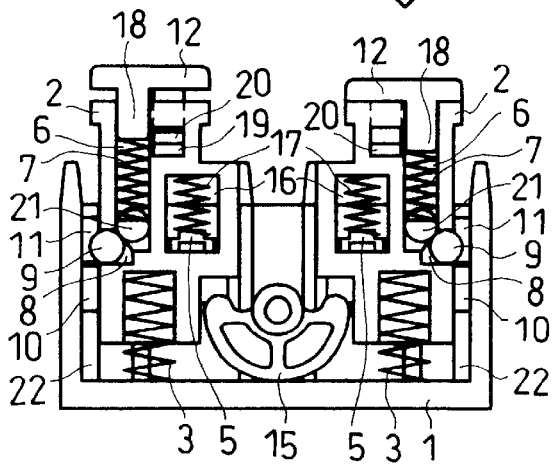
Figure 2:
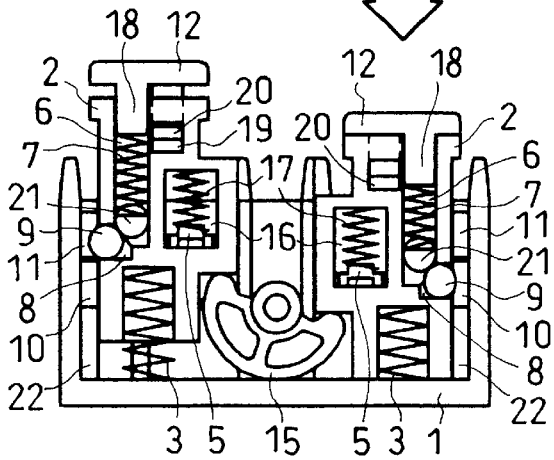

In the case where the push button 2 is pressed through the auxiliary push button 12, from the state in which the push button 2 is not pressed indicated in FIG. 1 and FIG. 2 (a), the push button 2 remains in the return position and only the auxiliary push button 12 is pushed down.

With this pressing of the auxiliary push button 12, the ball for temporary fastening 9 is pushed to outside by the compressed spring for ball 7, and engaged in the state in which part of it is urged to the return side concavity 11 (FIG. 2(*b*)).

With continued pressing of the auxiliary push button 12, the push button 2 is pushed in, by being pressed by the bottom part of the auxiliary push button 12 (FIG. 2(*c*)).

At that time, because part of the ball for temporary fastening 9 is engaged in the return side concavity 11, the push button 2 does not move until this ball for temporary fastening 9 gets away from the return side concavity 11 against the spring for ball 7, but is pushed in at a stroke after it accumulated a certain amount of force. This makes it possible to instantly connect the fixed contact 4 of the switch body 1 and prevent electric exhaustion, etc. of the contacts 4, 5.

In this way, as the push button 2 is pushed in to the end through the auxiliary push button 12, part of the pressed ball for temporary fastening 9 is engaged in the concavity 10 on the switch body 1 side, as shown in FIG. 2(*c*).

Figure 3:
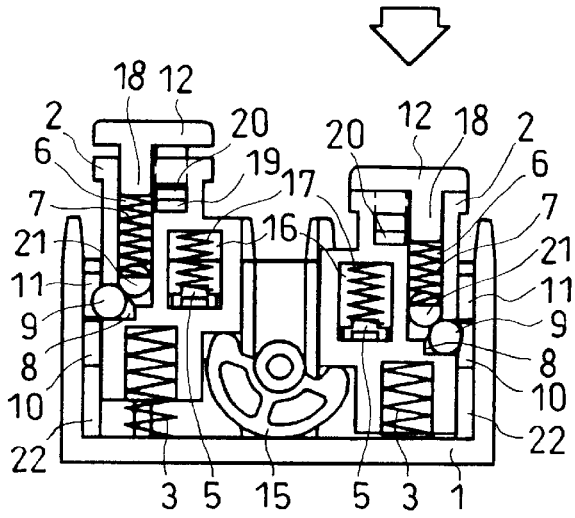
FIG. 3 is an explanatory chart showing the motion of said push-button switch.
Figure 3:
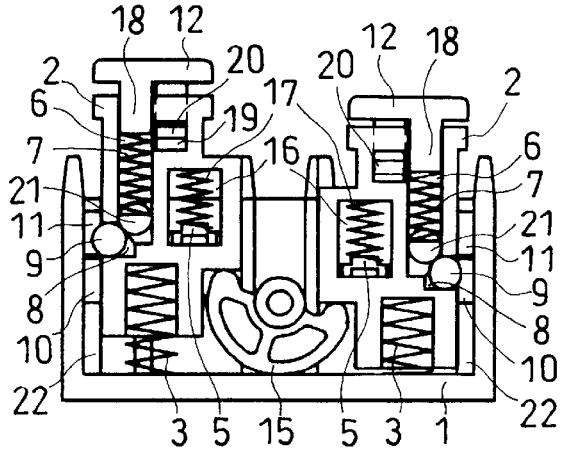
Figure 3:
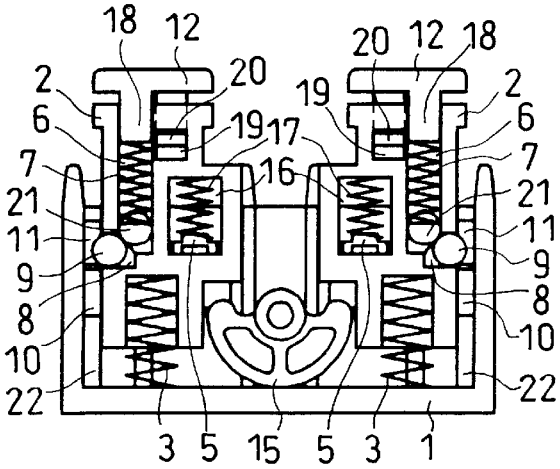
Figure 4:
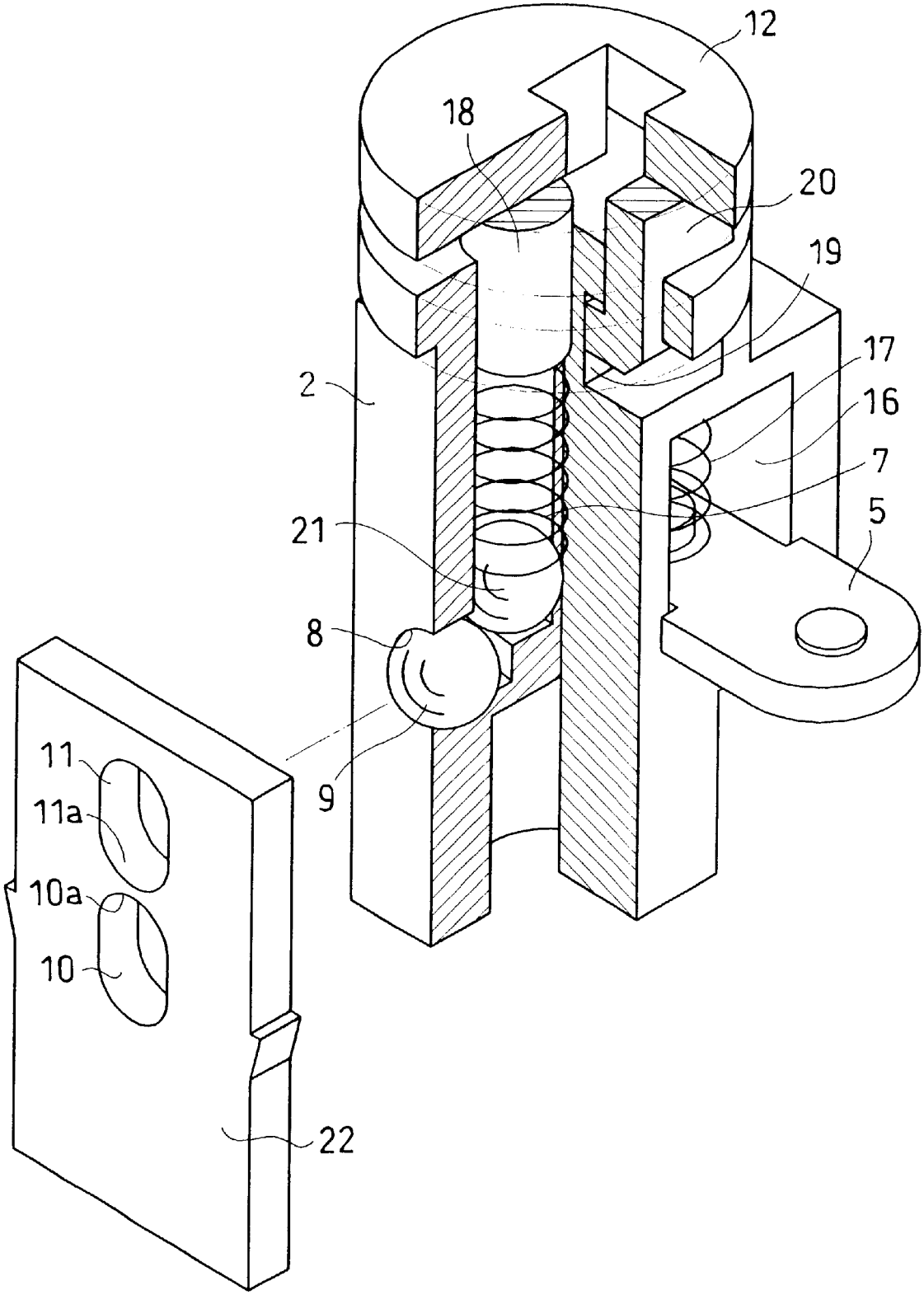
FIG. 4 is a partial perspective view part of which is omitted, showing said auxiliary push button and a state in which the push button is pressed.
Figure 5:
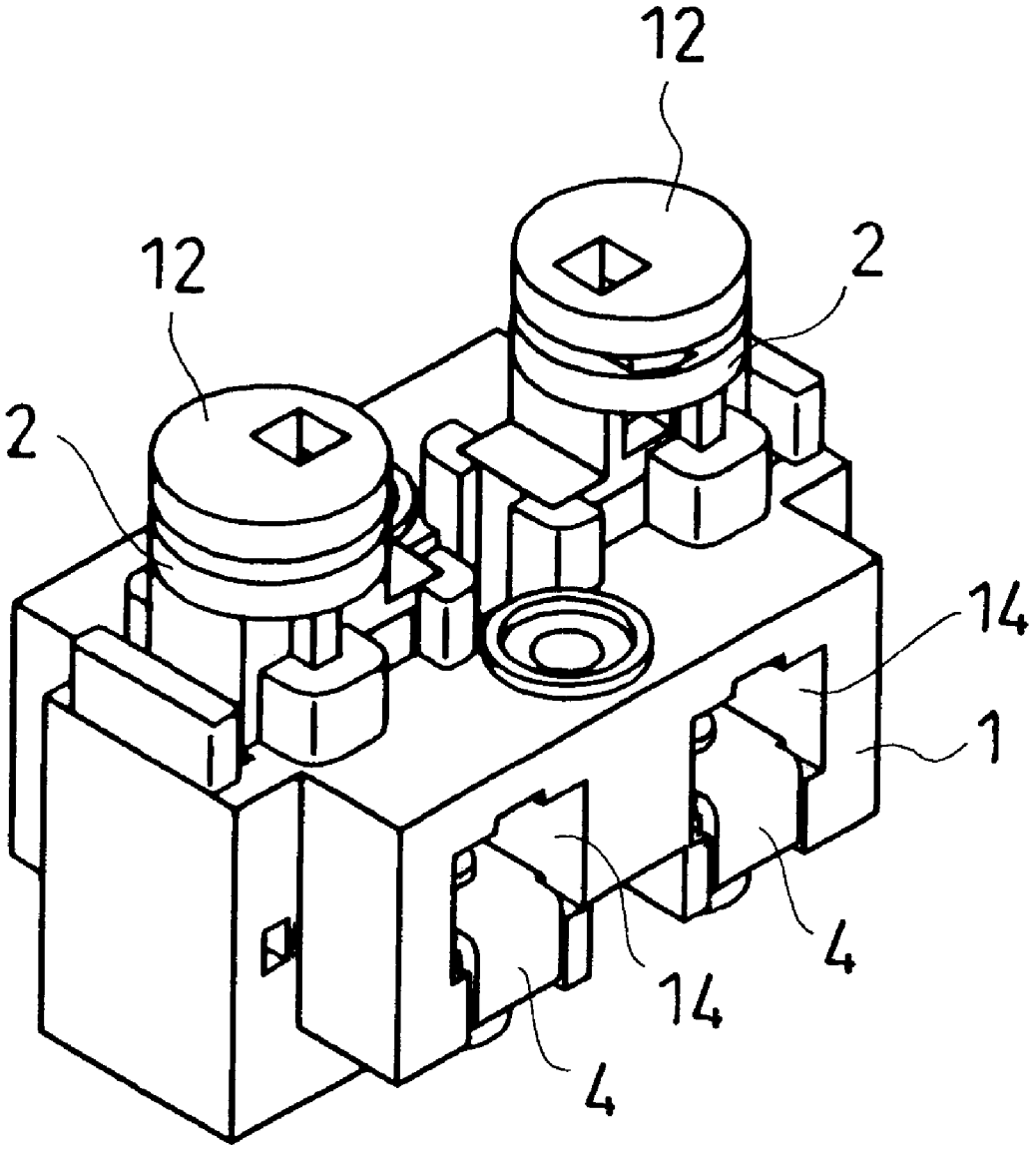
FIG. 5 is a perspective view of said push-button switch.
Figure 6:
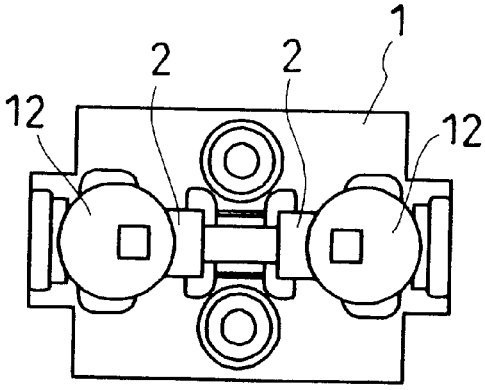
FIG. 6 shows said push-button switch, (a) being a plan view, (b) a front elevation, (c) a bottom face view, (d) a side view, and (e) a sectional view as seen sideways.
Figure 6:
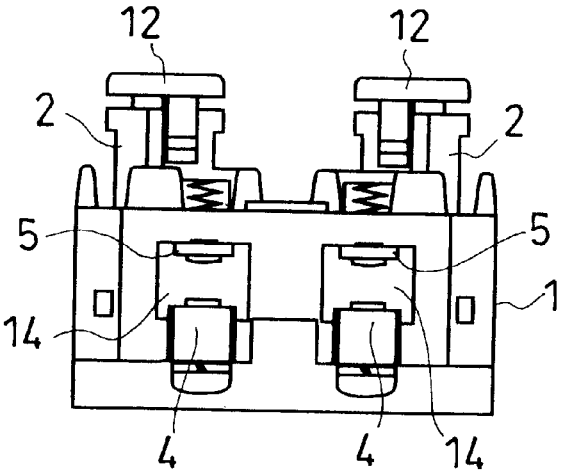
Figure 6:
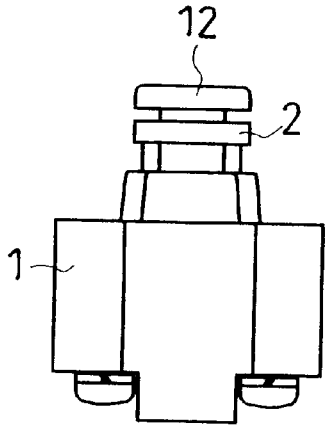
Figure 6:
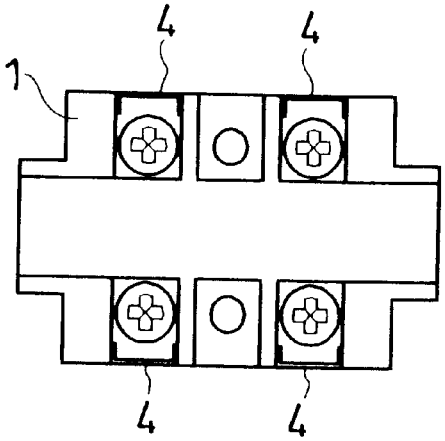
Figure 6:
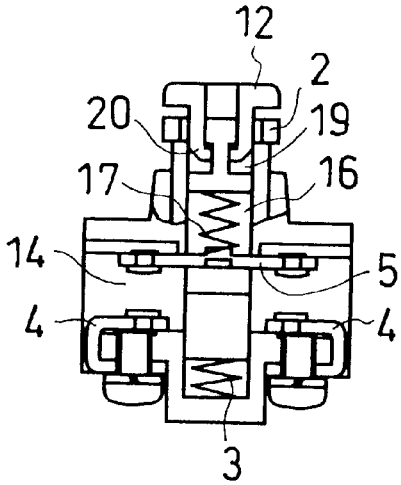
Figure 7:
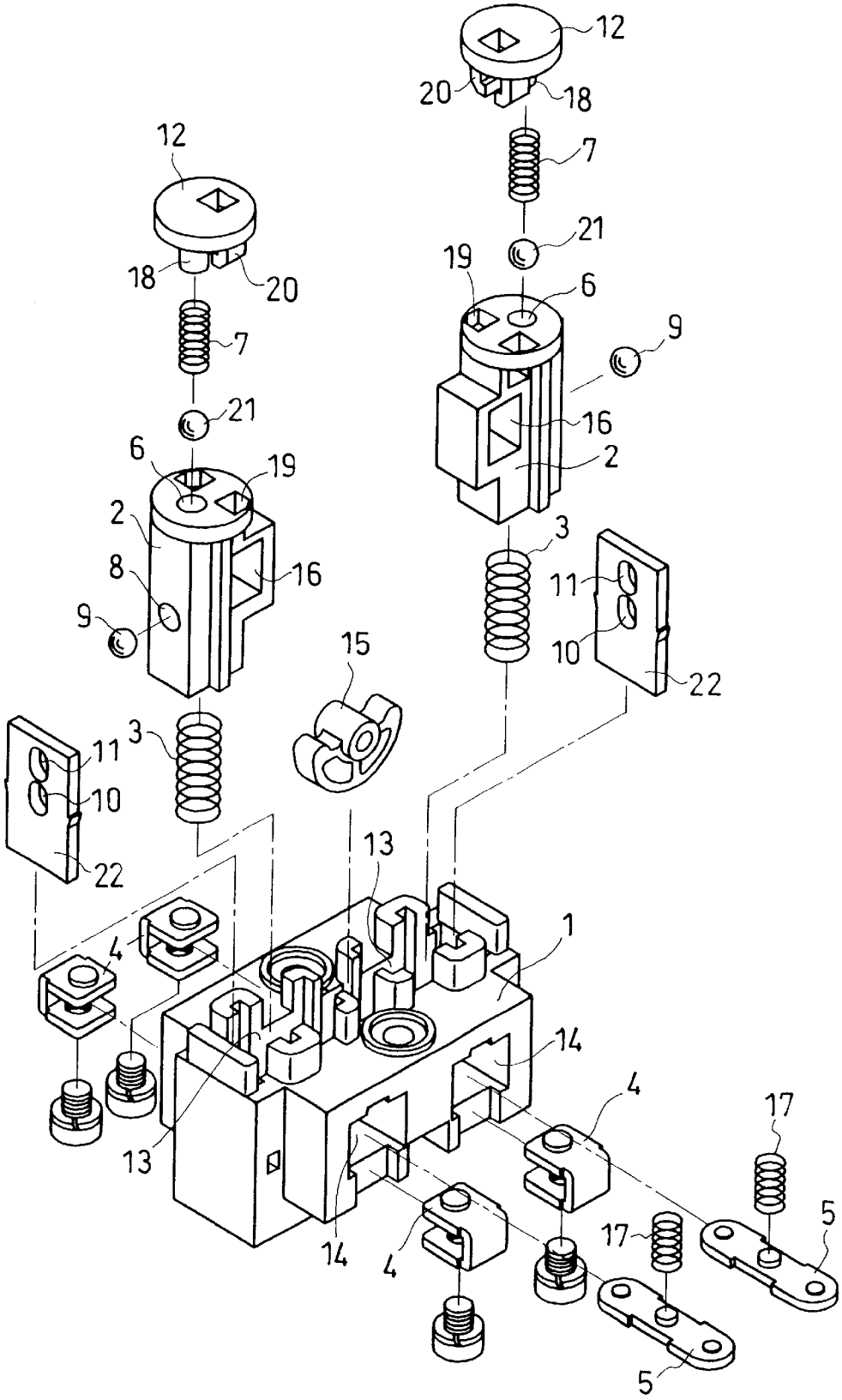
FIG. 7 is an exploded perspective view of said push-button switch.

And, because the ball for temporary fastening 9 is engaged in the concavity 10, even in case the force pressing the push button 2 through the auxiliary push button 12 diminished, from the state indicated in FIG. 2(*c*), the push button 2 is temporarily fixed at that position by the resisting force produced with the fastening of the ball for temporary fastening 9 in the stepped part 10*a* of the concavity 10, as shown in FIG. 3(*a*), thereby making it possible to lightly hold the push button 2, pushed in against the strong return spring 3, with a small force.

Next, in the case where the pressing force of the push button 2 applied through the auxiliary push button 12 is released, from the state indicated in FIG. 2(*c*) or FIG. 3(*a*), the auxiliary push button 12 returns in the first place, and the pressing force pushing the ball for temporary fastening 9 to outside with the auxiliary push button 12 diminishes (FIG. 3(*b*)).

As a result of the above action, the resisting force due to fastening of the ball for temporary fastening 9 to the stepped part 10*a* of the concavity 10 diminishes, and the ball for temporary fastening 9 is disengaged from the concavity 10, to apply the urging force of the return spring 3 directly to the push button 2, thus obtaining a large returning force.

As described above, by releasing the pressing force of the push button 2 exerted through the auxiliary push button 12, it becomes possible to make the push button 2 to return accurately (FIG. 3(*c*)) to its initial return position (FIG. 1 and FIG. 2(*a*)).

At that time, since the push button 2 returns to the return position at a stroke, the connection between the fixed contact 4 of the switch body 1 and the mobile contact 5 is instantly cut off, electric exhaustion, etc. of the contacts 4, 5 can be prevented.

Figure 8:
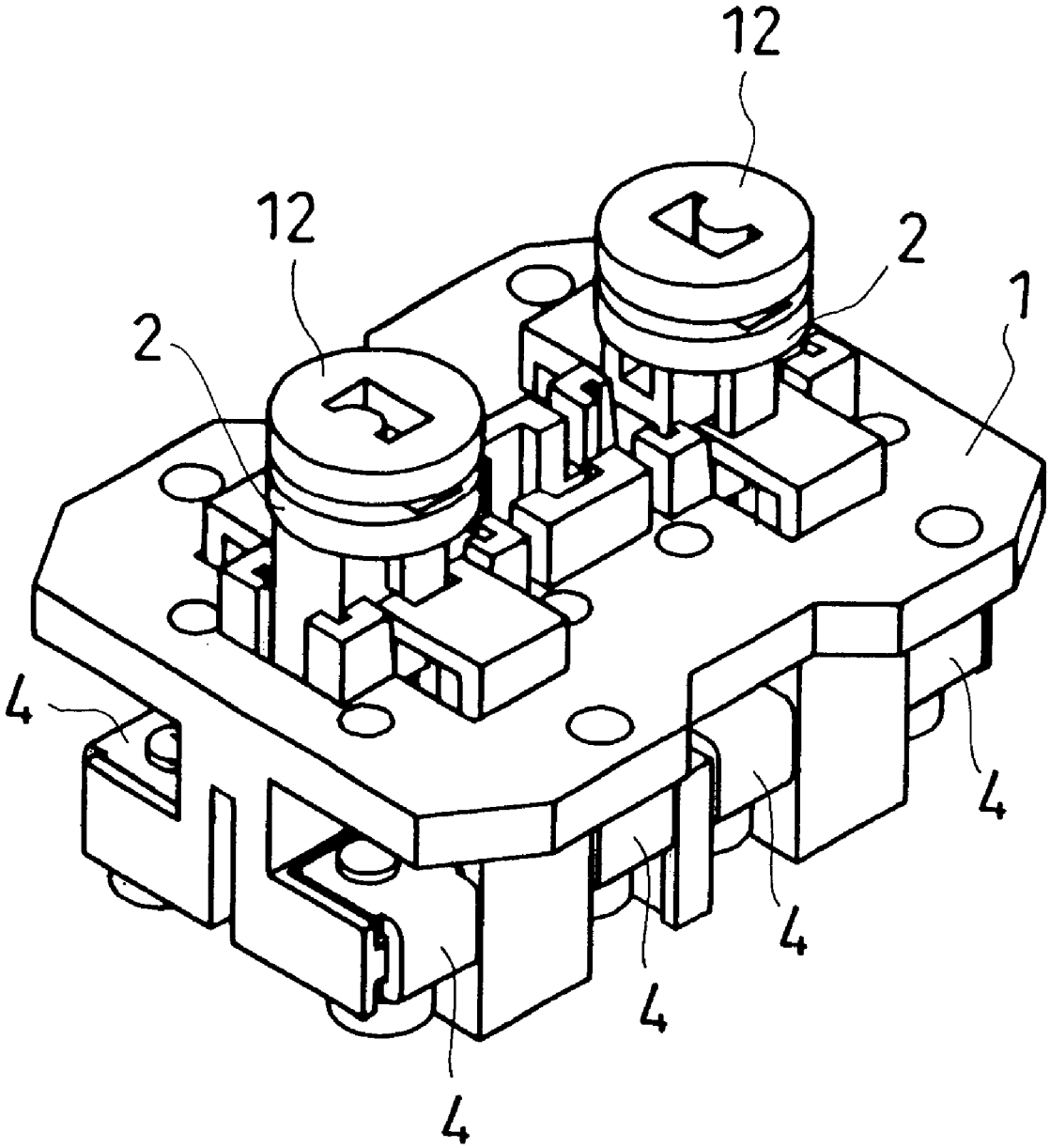
FIG. 8 is a perspective view showing the second embodiment of the push-button switch according to the present invention.
Figure 9:
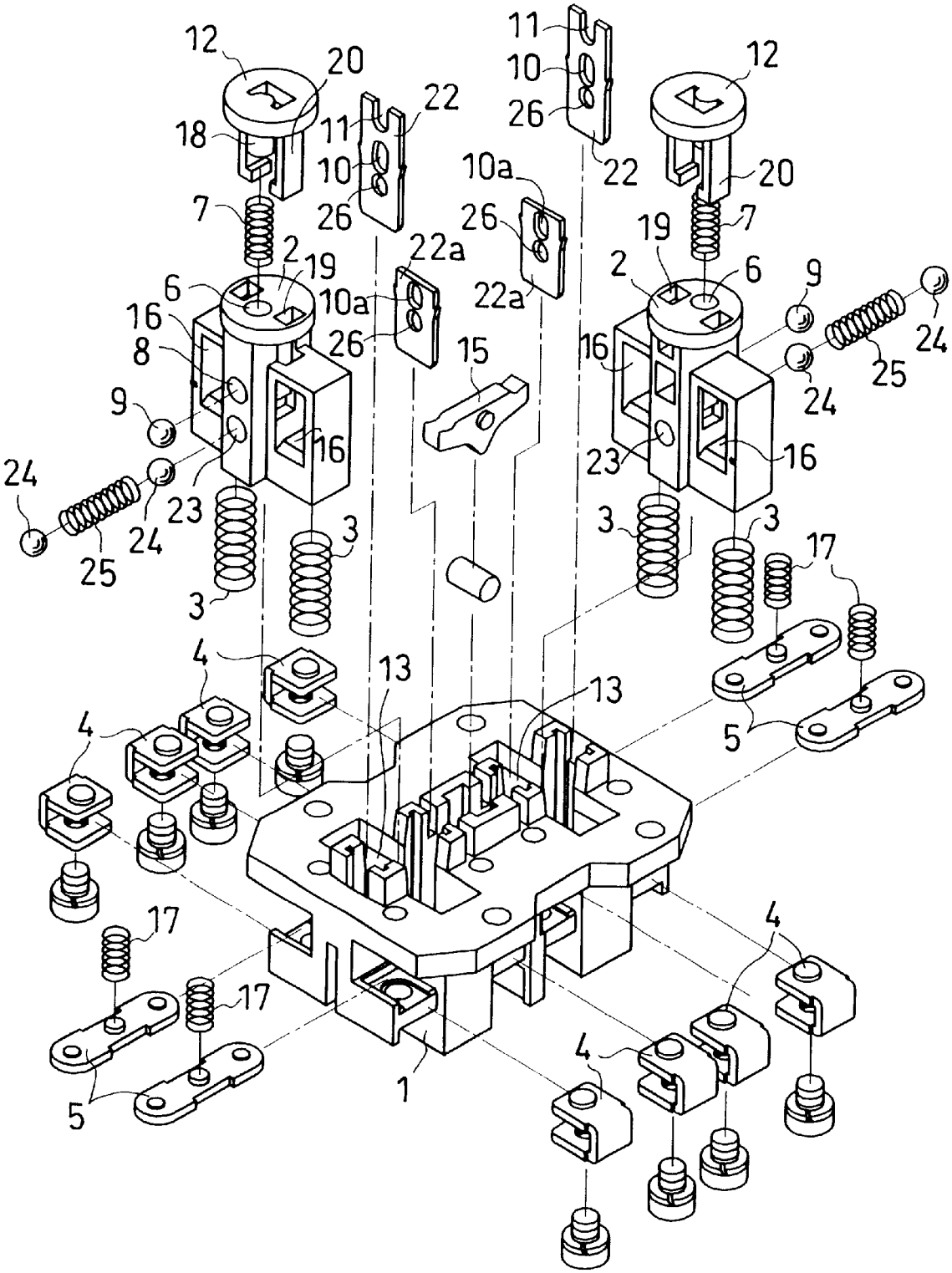
FIG. 9 is an exploded perspective view of said push-button switch.
Figure 10:
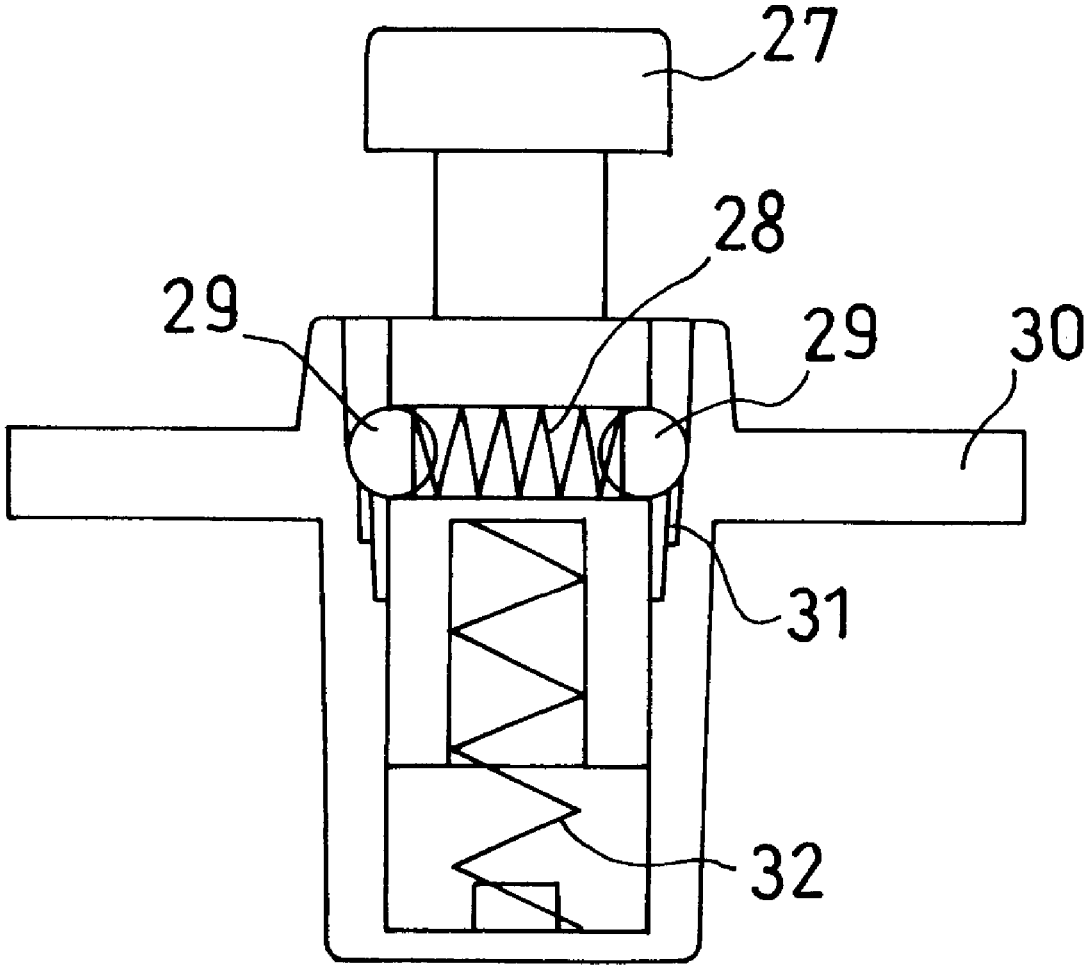
FIG. 10 PRIOR ART
FIG. 10 is a sectional view showing a conventional push-button switch.

Next, FIGS. 8 and 9 indicate the second embodiment of the push-button switch according to the present invention.

This push-button switch, realized by applying the construction of the present invention to a so-called 2*a* contact type push-button switch, which is constructed in such a way that 2 contacts are simultaneously opened and closed with pressing operation of the push button 2, comprises 2 pairs of space 16, mobile contact 5 and spring for mobile contact 17 against one push button 2, and is provided with 2 pairs of fixed contact 4 on the switch body 1.

And, in this push-button switch, a storing hole 23 is formed in a way to intersect the shaft of the push button 2 about orthogonally, and in this storing hole 23 are inserted 2 clip balls 24 with a spring for clip ball 25 interposed between the two.

One clip ball 24 is engaged in the concavity for clip 26 formed below the concavity 10 of the plate 22, at the pressed position of the push button 2, in the state urged by the spring for clip ball 25, and is engaged in the concavity 10 of the plate 22, at the return position of the push button 2.

In addition, the other clip ball 24, urged toward the plate 22*a* fixed to the switch body 1 in a way to face the plate 22, is engaged in the concavity for clip 26 of the plate 22*a*, at the pressed position of the push button 2, and is engaged in the return side concavity 10*a*, at the return position of the push button 2.

As described above, by providing clip balls 24, the distinction between the pressed position and the return position of the push button 2 becomes sensorially clear, and it becomes possible to prevent electric exhaustion of the contacts 4, 5 and trouble due to time lag of connection of a plural number of pairs of contacts, etc., by instantly connecting the fixed contact 4 of the switch body 1, in addition to the action of the ball for temporary fastening 9 and the return side concavity 11.

As for other constructions of the push-button switch according to the present invention, explanation of the construction and actions will be omitted by just giving one same symbol to one same member, because they are the same as those of the push-button switch of said first embodiment.

As an explanation has so far been given on embodiments of the present invention, the spring force of the spring for ball 7 can be set as required in a range weaker than that of the return spring 3, and the restrictive force at pressed position of the push button 2 can be adjusted with an adjustment of the depth of engagement of the ball for temporary fastening 9 in the concavity 10.

What is claimed is:

1. A push-button switch comprising:

a switch body;

a main push button slidably disposed in said switch body between an initial position and a depressed position, with said main push button having a hole formed therein which extends in a direction that is oriented from the initial position toward the depressed position;

a return spring for urging said main push button from the depressed position toward the initial position;

a biasing spring in said hole;

an opening in a side wall of said main push button, with said opening being in communication with a bottom of said hole;

a ball at said opening;

a concavity in a wall of said switch body that faces said main push button, wherein said concavity is to receive a part of said ball when said main push button is at the depressed position; and an auxiliary push button disposed at a top of said main push button, wherein said auxiliary push button is positioned against said biasing spring such that said biasing spring urges said auxiliary push button away from said main push button in a direction that is oriented from the depressed position toward the initial position, whereby with said main push button in the depressed position, when said auxiliary push button is depressed against said biasing spring, said biasing spring forces said ball partly through said opening such that said ball is partly received within said concavity to temporarily fix said main push button at the depressed position.

2. The push-button switch according to claim 1, further comprising an additional concavity in said wall of said switch body that faces said main push button, wherein said additional concavity is to receive a part of said ball when said main push button is at the initial position to temporarily fix said main push button at the initial position.

* * * * *